United States Patent [19]

Kabuto et al.

[11] Patent Number: 4,993,976

[45] Date of Patent: Feb. 19, 1991

[54] STEERING SYSTEM FOR OUTBOARD MOTOR

[75] Inventors: Katsukuni Kabuto, Aichi; Fumikazu Sugimoto, Gifu; Kasataka Kase, Kawasaki; Manabu Yamada, Gifu, all of Japan

[73] Assignee: Kayaba Industry Co. Ltd., Japan

[21] Appl. No.: 520,788

[22] Filed: May 8, 1990

[51] Int. Cl.[5] ..... B63H 21/26

[52] U.S. Cl. ..... 440/53; 440/62; 114/144 R; 74/480 B

[58] Field of Search ..... 440/1, 53, 61, 62, 63, 440/75, 78; 114/144 R, 144 E; 180/79.1, 79.3; 74/89.2, 388 R, 388 PS, 496, 480 B

[56] References Cited

U.S. PATENT DOCUMENTS

| | | | |
|---|---|---|---|
| 4,014,281 | 3/1977 | Hemens | 440/62 |
| 4,419,084 | 12/1983 | Borst | 114/144 R |
| 4,483,682 | 11/1984 | Cavil et al. | 440/53 |
| 4,500,298 | 2/1985 | Hall et al. | 440/62 |
| 4,592,732 | 6/1986 | Ferguson | 440/63 |
| 4,744,777 | 5/1988 | Ferguson | 440/63 |

*Primary Examiner*—Sherman Basinger
*Assistant Examiner*—Stephen P. Avila
*Attorney, Agent, or Firm*—Steinberg & Raskin

[57] ABSTRACT

A steering system for an outboard motor capable of improving the operability and the responsibility to an emergency. In the steering system, a torque sensor is actuated depending upon rotation of a steering wheel to generate an output signal. The so-generated output signal is then fed to an electric motor to drive it, so that the electric motor generates torque for assisting steering of an outboard motor.

4 Claims, 2 Drawing Sheets

STEERING SYSTEM FOR OUTBOARD MOTOR

BACKGROUND OF THE INVENTION

This invention relates to a steering system for an outboard motor, and more particularly to a steering system for an outboard motor which is adapted to reduce steering force and improve the operability.

A steering system which has been conventionally used for an outboard motor is typically constructed in such a manner as shown in FIG. 7. More specifically, the conventional steering system includes a steering wheel 101 fixedly mounted on a steering shaft 103, on which a drum 105 is also fixedly mounted. A cable 107 is wound at one end thereof on the drum 105 and arranged so as to extend to an outboard motor 109. Then, the cable 107 is connected at the other end thereof to a guide member 111. The cable 107 is substantially received in a sleeve 113. To the guide member 111 is connected a steering rod 115, which is then connected to an oscillation lever 117 fixed on the outboard motor 109.

In the conventional steering system constructed as described above, when the steering wheel 101 is rotated in a desired direction, the steering shaft 103 is rotated in the same direction, leading to rotation of the drum 105. The rotation of the drum 105 causes the cable 107 to be wound on or delivered from the drum 105. This results in the oscillation lever 115 and therefore the outboard motor 109 to be pivotally moved, to thereby carry out desired steering.

Unfortunately, in the conventional steering system, a large amount of steering force is required to carry out steering because friction significantly occurs between the cable 107 and the sleeve 113, to thereby cause much force to be required to operate the steering wheel 101. This leads to deterioration of the operability and fails to satisfactorily keep feeling of the steering. In particular, when the steering operation of the steering system is carried out against the reaction force of a propeller (not shown) of the outboard motor 109, it is required to increase steering force, so that there is a possibility of failing to rapidly accommodate an emergency such as a sudden turn required to avoid an obstacle.

SUMMARY OF THE INVENTION

The present invention has been made in view of the foregoing disadvantage of the prior art.

Accordingly, it is an object of the present invention to provide a steering system for an outboard motor which is capable of improving the operability.

It is another object of the present invention to provide a steering system for an outboard motor which is capable of permitting the steering operation to be carried out with substantially less steering force.

It is a further object of the present invention to provide a steering system for an outboard motor which is capable of significantly improving the responsibility to an emergency.

It is still another object of the present invention to provide a steering system for an outboard motor which is capable of rapidly accommodating a sudden accident or emergency.

It is yet another object of the present invention to provide a steering system for an outboard motor which is capable of simplify and small size the construction of the system.

It is a still further object of the present invention to provide a steering system for an outboard motor which is capable of accomplishing the above described objects with a simple structure.

In accordance with the present invention, a steering system for an outboard motor is provided. The steering system includes an input shaft, a steering wheel mounted on the input shaft, an output shaft, and a drum which is mounted on the output shaft and on which a cable is wound. The cable is connected at the distal end thereof to the outboard motor. Also, the steering system includes a torque sensor arranged between the input shaft and the output shaft to detect steering torque supplied through the steering wheel thereto, resulting in generating a detection signal. Further, the steering system includes an electric motor for generating an output for the output shaft, a speed reducer for reducing the speed of the output of the electric motor to feed the output reduced to the output shaft and a control device for generating a control signal depending upon the detection signal generated from the torque sensor and feeding it to the electric motor to cause the output of the electric motor to correspond to the steering torque.

In a preferred embodiment of the present invention, the torque sensor comprises a planet gear type torque sensor.

In a preferred embodiment of the present invention, the speed reducer comprises a plurality of gears interposedly arranged between a revolving shaft of the electric motor and the output shaft.

In another preferred embodiment of the present invention, the speed reducer comprises a hypoid gear integrally provided on the drum and a hypoid pinion mounted on a revolving shaft of the electric motor so as to be engaged with the hypoid gear.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein:

FIGS. 1 to 5 show an embodiment of a steering system for an outboard motor according to the present invention, wherein FIG. 1 is a schematic diagrammatic view showing an embodiment of a system for an outboard motor according to the present invention, FIG. 2 is a fragmentary perspective view showing a torque sensor and a speed reducer in the steering system shown in FIG. 1, FIG. 3 is a perspective view showing a stopper mechanism in the steering system shown in FIG. 1, FIG. 4 is a sectional view taken along IV—IV of FIG. 2 and FIG. 5 is a sectional view taken along line V—V of FIG. 2;

DETAILED DESCRIPTION OF THE PREFERRED EMBODIMENTS

Figure 1:
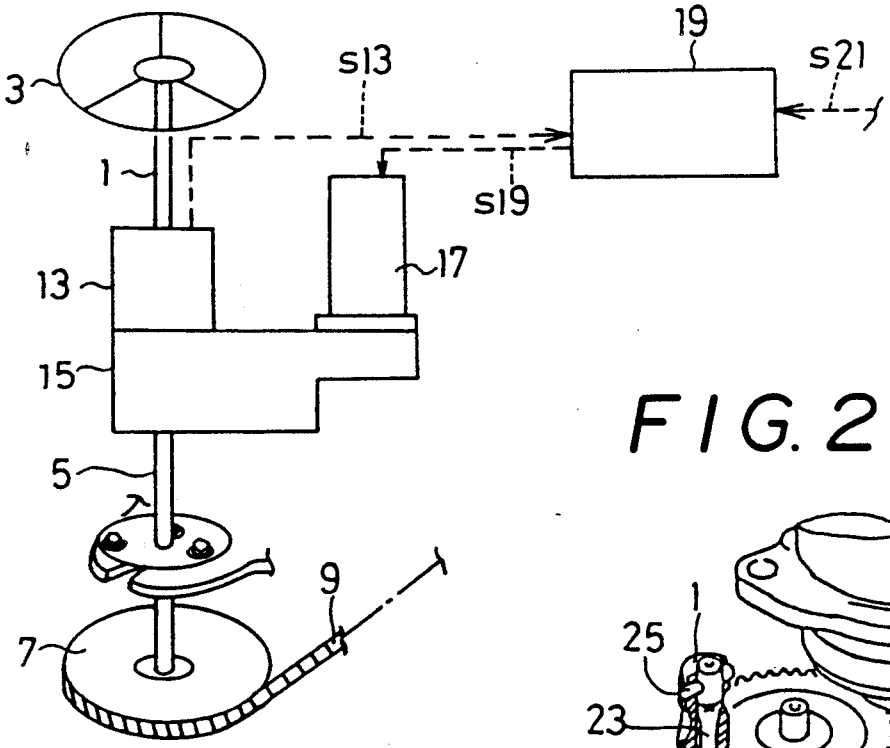

Now, a steering system for an outboard motor according to the present invention will be described hereinafter with reference to FIGS. 1 to 6, wherein like reference numerals designate like or corresponding parts throughout.

Referring now to FIGS. 1 to 5 illustrating an embodiment of a steering system for an outboard motor according to the present invention, a steering system of the illustrated embodiment includes an input shaft 1, a steering wheel 3 fixedly mounted on the input shaft 1, an output shaft 5, and a drum 7 fixedly mounted on the output shaft 5. The steering system also includes a cable 9 connected at one end or the proximal end thereof to the drum 7, wound thereon and connected at the other end or distal end thereof to an outboard motor (not shown).

Between the input shaft 1 and the output shaft 5 are interposedly arranged a torque sensor 13 and a speed reducer 15. The speed reducer 15 is connected to an electric motor 17. The torque sensor 13 serves to detect steering torque input to the system through the steering wheel 3 to generate a detection signal s13, which is then supplied to a control device 19. Then, the control device 19 generates a control signal s19 depending upon the so supplied detection signal s13, which control signal s19 is then supplied to the electric motor 17, so that the electric motor 17 carries out actuation or rotation corresponding to the steering torque. Thus, in the illustrated embodiment, it is merely required to carry out after the initial operation through the steering wheel 3, and the subsequent steering operation desired takes place substantially depending upon the rotation of the electric motor 17.

Also to the control device 19 is input a rotation signal indicating the revolving speed of the outboard motor therefrom, which rotation signal cooperates with the detection signal or steering torque signal s13 to permit optimum control of the output to be carried out.

In the illustrated embodiment, the torque sensor 13 comprises a planet gear type torque sensor, which will be detailedly described hereinafter with reference to FIGS. 2 to 5.

Figure 3:
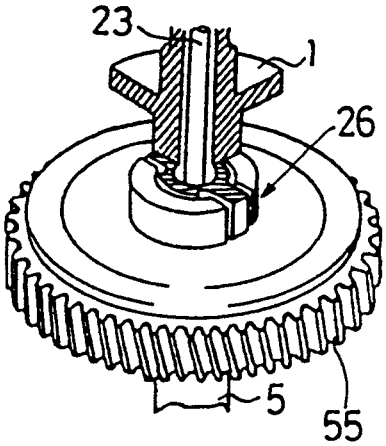

In the input shaft 1 is arranged a torsion bar 23. The torsion bar 23 is fixedly mounted at one end thereof on the input shaft 1 through a pin 25 and pressedly inserted or fitted at the other end thereof in the output shaft 5. Revolving force generated from the steering wheel 5 is transmitted through the input shaft 1 and torsion bar 23 to the output shaft 5, during which torsion is produced in the torsion bar 23 depending upon the operation force, resulting in relative rotation occurring between the input shaft 1 and the output shaft 5. The output shaft 5, as shown in FIG. 3, is provided with a stopper mechanism 26, which serves to prevent a failure of the torsion bar 23 due to excessive torsion. Also, the stopper mechanism 26 permits the steering system to be changed over to manual operation when the torsion bar 23 is damaged or broken.

Figure 4:
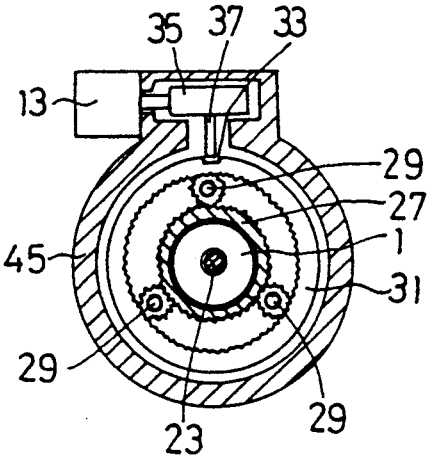
Figure 5:
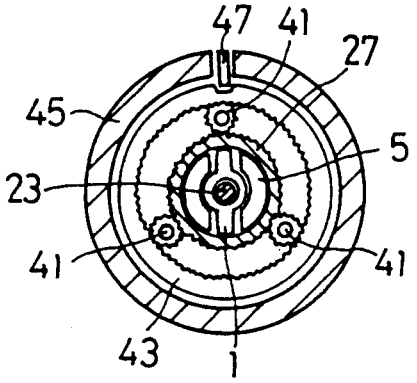

On the input shaft 1, as shown in FIG. 4, a sun gear 27 is rotatably fitted, with which are meshedly engaged three planet gears 29. The planet gears 29 are fixedly mounted on the input shaft 1. The planet gears 29 are also meshed or engaged with a common ring gear 31 arranged outside the planet gears 29. The ring gear 31 is formed at a predetermined position on the outer periphery thereof with a recess 33. The torque sensor 13 includes a spool 35, to which a pin 37 is connected in a manner to be in association with the recess 33. Also on the output shaft 5 are planet gears 41 are mounted as shown in FIG. 5. The planet gears 41 are engaged with the sun gear 27 and also engaged with a common ring gear 43 arranged outside the gears 41. The above-described gears are arranged in a gear box 45 and the ring gear 47 is fixed at the gear box 45 through a pin 47.

Figure 2:
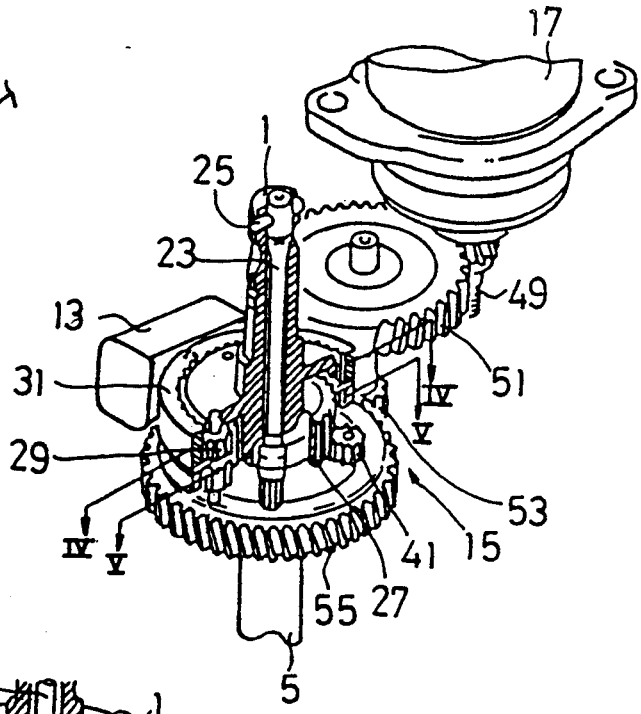

In the illustrated embodiment, the speed reducer 15 may comprise a plurality of gears. More particularly, as shown in FIG. 2, on a revolving shaft of the electric motor 17 is mounted a gear 49, which is then engaged with a drive gear 51 arranged coaxial with a gear 53. With the gear 53 is engaged a gear 55 which is mounted on the output shaft 5. Thus, rotation of the electric motor 17 is transmitted through the gear 9, drive gear 51, gear 53 and gear 55 to the output shaft 5 while being reduced through the gears.

Now the steering system of the illustrated embodiment constructed as described above will be described hereinafter.

When the steering wheel 3 is operated, the input shaft 1 is rotated, of which the revolving force is transmitted through the torsion bar 23 to the output shaft 5. However, the output shaft 5 is prevented from being rotated due to friction of the shaft 5 with the cable 9 and friction of the outboard motor with water. This causes the torsion bar 23 to be subject to torsion by an amount corresponding to such friction, so that the input shaft 1 may be excessively rotated with respect to the output shaft 5 by an amount corresponding to an angle of such torsion of the torsion bar 23.

The so-generated difference in rotation between the input shaft 1 and the output shaft 5 causes the spool 35 of the torque sensor 13 to be moved through the gears on the side of the input shaft 1. This results in steering torque being detected, which is then supplied in the form of the detection signal s13 to the control device 19. The control device 19 generates the control signal s19 depending upon the so-supplied detection signal s13, which is then supplied to the electric motor 17, so that the electric motor 17 generates torque for assisting steering depending upon the control signal s19. The so-generated output of the electric motor 17 is transmitted through the gear 49, drive gear 51, gear 53 and gear 55 to the output shaft 5 to rotate it, leading to desired steering.

The above-described rotation of the output shaft 5 causes each of the planet gears 41 mounted on the output shaft 5 to revolve around the sun gear 27 while revolving on its axis. However, the ring gear 43 is fixed at the gear box 45, so that the rotation of the planet gears 41 leads to rotation of the sun gear 27. Such rotation of the sun gear 27 causes the gears on the side of the input shaft 1 to be reversed, resulting in gradually stopping the electric motor 17 while returning the torque sensor 13 to a neutral position.

As can be seen from the foregoing, the steering system of the illustrated embodiment is so constructed that the torque sensor is actuated depending upon rotation of the steering wheel to generate an output signal, which is then fed to the electric motor to drive it, resulting in the electric motor generating torque for assisting steering of the outboard motor. Such construction permits steering force for the outboard motor to be substantially decreased and feeling of the steering to be improved. More specifically, when it is desired to suddenly turn an outboard boat through the outboard motor in order to accommodate any emergency, it is merely required to carry out the initial operation of the steering system through the steering wheel and the subsequent steering operation is rapidly carried out utilizing steering force exerted by the electric motor 17.

Now, another embodiment of a steering system for an outboard motor according to the present invention will be described hereinafter with reference to FIG. 6.

A steering system of the illustrated embodiment includes a torque sensor 13 of the planet gear type as in the above-described embodiment and a hypoid gear 61 integrally mounted on a drum 7. Also, the steering system includes a hypoid pinion 63 mounted on a revolving shaft of the electric motor 17 so as to be engaged with the hypoid gear 61. Thus, the hypoid gear 61 and hypoid pinion 63 cooperate with each other to constitute a speed reducer 15. The remaining part of the illustrated embodiment may be constructed in substantially the same manner as the above-described embodiment.

Figure 6:
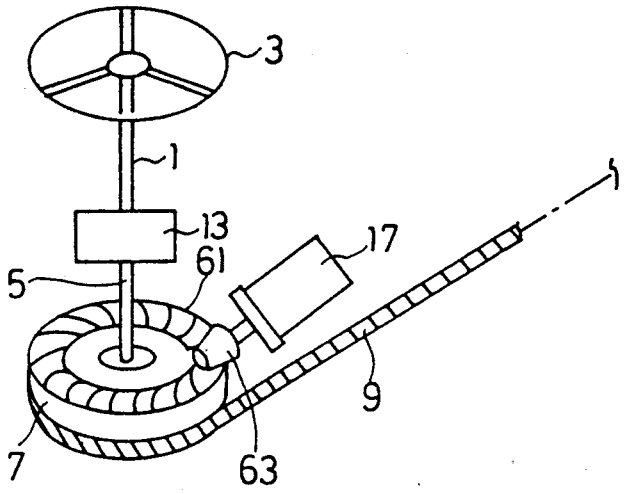
FIG. 6 is a schematic perspective view showing another embodiment of a steering system for an outboard motor according to the present invention.
Figure 7:
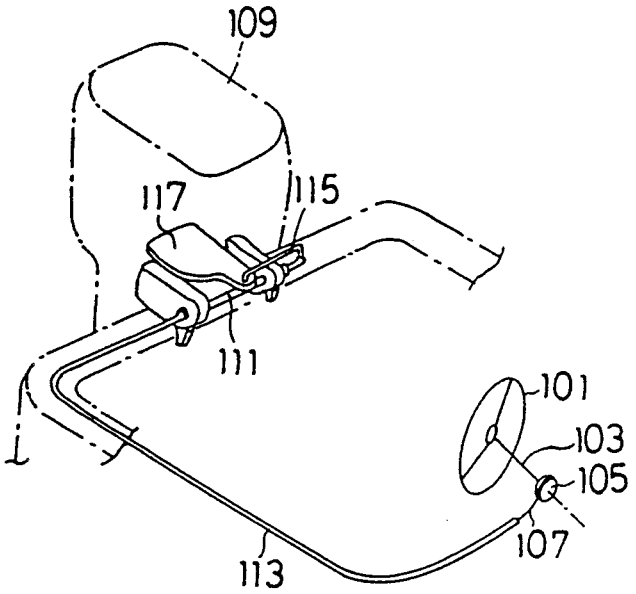
FIG. 7 (PRIOR ART)
FIG. 7 is a perspective view showing a conventional steering system for an outboard motor.

Thus, it will be noted that the embodiment shown in FIG. 6 exhibits the advantages of the above-described embodiment, as well as an advantages of simplifying the construction of the speed reducer, to thereby simplify and small-size the steering system.

While preferred embodiment of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A steering system for an outboard motor comprising:

an input shaft;

a steering wheel mounted on said input shaft;

an output shaft;

a drum which is mounted on said output shaft and on which a cable is wound, said cable being connected at the distal end thereof to the outboard motor;

a torque sensor arranged between said input shaft and said output shaft to detect steering torque supplied through said steering wheel thereto, to thereby generate a detection signal;

an electric motor for generating an output for said output shaft;

a speed reducer for reducing the speed of said output of said electric motor to feed said output reduced to said output shaft; and a control device for generating a control signal depending upon said detection signal generated from said torque sensor and feeding it to said electric motor to cause said output of said electric motor to correspond to said steering torque.

2. A steering system for an outboard motor as defined in claim 1, wherein said torque sensor comprises a planet gear type torque sensor.

3. A steering system for an outboard motor as defined in claim 1, wherein said speed reduced comprises a plurality of gears interposedly arranged between a revolving shaft of said electric motor and said output shaft.

4. A steering system for an outboard motor as defined in claim 1, wherein said speed reducer comprises a hypoid gear integrally provided on said drum and a hypoid pinion mounted on a revolving shaft of said electric motor so as to be engaged with said hypoid gear.

* * * * *